US011263967B2

(12) United States Patent
Nielsen et al.

(10) Patent No.: US 11,263,967 B2
(45) Date of Patent: Mar. 1, 2022

(54) DYNAMIC VOLTAGE DISPLAY DRIVER

(71) Applicant: Microsoft Technology Licensing, LLC, Redmond, WA (US)

(72) Inventors: Gregory Nielsen, Kirkland, WA (US); Chau Van Ho, Des Moines, WA (US); Mika Juhani Rintamaeki, Redmond, WA (US); Samu Matias Kallio, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 16/132,267

(22) Filed: Sep. 14, 2018

(65) Prior Publication Data

US 2020/0090588 A1 Mar. 19, 2020

(51) Int. Cl.
*G09G 3/3258* (2016.01)
*G09G 3/20* (2006.01)

(52) U.S. Cl.
CPC ..... *G09G 3/3258* (2013.01); *G09G 3/2003* (2013.01); *G09G 2320/0242* (2013.01); *G09G 2320/041* (2013.01)

(58) Field of Classification Search
CPC ..... G09G 3/3258; G09G 3/2003; G09G 2320/0242; G09G 2320/041; G09G 3/30; G09G 3/3275; G09G 3/3208; G09G 2340/14
See application file for complete search history.

(56) References Cited

U.S. PATENT DOCUMENTS 4,706,740 A * 11/1987 Mahefkey ..... B64G 1/503 165/104.14
5,850,205 A 12/1998 Blouin
5,936,604 A 8/1999 Endou
(Continued)

FOREIGN PATENT DOCUMENTS

JP 2001147672 A 5/2001

OTHER PUBLICATIONS

"Samsung Launches the Notebook Odyssey Z for an Unparalleled Gaming Experience", Retrieved from: https://news.samsung.com/global/samsung-launches-the-notebook-odyssey-z-for-an-unparalleled-gaming-experience, Apr. 3, 2018, 5 Pages.
(Continued)

*Primary Examiner* — Christopher E Leiby
(74) *Attorney, Agent, or Firm* — Holzer Patel Drennan

(57) ABSTRACT

OLED display color output may vary substantially as a function of display temperature, which changes over time. Luminance of each of the pixels is defined by the current flowing therethrough, which is a function of the applied voltage and resistivity of the pixels. Temperature affects the resistivity of the pixels and thus the current flowing therethrough if voltage is held constant. The temperature response of red, green, and blue pixels differs, particularly at low applied voltage levels. As a result, the relative luminance of red, green, blue may vary with temperature changes, which may yield an undesirable overall color variance. The presently disclosed systems and methods dynamically adjust driving voltage to maintain color quality within a desired specification, while also reducing (or in some implementations, minimizing) power consumption of the OLED display.

21 Claims, 5 Drawing Sheets

(56) References Cited

U.S. PATENT DOCUMENTS

| | | | | |
|---|---|---|---|---|
| 6,313,821 | B1 | 11/2001 | Mizuno | |
| 6,388,388 | B1 | 5/2002 | Weindorf et al. | |
| 6,731,265 | B1 | 5/2004 | Kokuhata et al. | |
| 7,928,973 | B2 | 4/2011 | Oku et al. | |
| 8,934,235 | B2 * | 1/2015 | Rubenstein | F28D 15/0275 361/679.47 |
| 9,743,554 | B2 | 8/2017 | McLaughlin et al. | |
| 2004/0095721 | A1 * | 5/2004 | Ellsworth, Jr. | H01L 23/467 361/694 |
| 2006/0050038 | A1 * | 3/2006 | Cheon | G09G 3/3648 345/89 |
| 2009/0050309 | A1 * | 2/2009 | Yu | G06F 1/206 165/200 |
| 2013/0241490 | A1 * | 9/2013 | Kim | H01M 10/6556 320/112 |
| 2014/0041827 | A1 | 2/2014 | Giaimo et al. | |
| 2015/0346784 | A1 | 12/2015 | Delano et al. | |
| 2016/0048363 | A1 | 2/2016 | North et al. | |
| 2016/0171931 | A1 * | 6/2016 | Liu | G09G 3/3208 345/694 |
| 2018/0090109 | A1 | 3/2018 | Lin et al. | |
| 2019/0147782 | A1 * | 5/2019 | Pyun | G09G 3/006 345/214 |
| 2019/0189042 | A1 * | 6/2019 | Aurongzeb | G09G 3/2003 |

OTHER PUBLICATIONS

Onawole, Habeeb, "ASUS Launches ROG Gaming Smartphone: Brings 90Hz OLED Screen, 3D Vapor Cooling Chamber and Lots of Docks", Retrieved from: https://www.gizmochina.com/2018/06/04/asus-launches-rog-gaming-smartphone-brings-90hz-oled-screen-3d-vapor-cooling-chamber-and-lots-of-docks/, Jun. 4, 2018, 8 Pages.

"International Search Report and Written Opinion Issued in PCT Application No. PCT/US2019/038857", dated Nov. 27, 2019, 18 Pages.

* cited by examiner

DYNAMIC VOLTAGE DISPLAY DRIVER

BACKGROUND

In an organic light-emitting diode (OLED) display, an emissive electroluminescent layer selectively emits light in discrete areas in response to an applied electric current. Varying electrical currents are selectively applied to each pixel within the OLED display to create desired images. OLED displays may be color patterned using a variety of techniques, including RGB pixelation via a shadow mask. The end result of an RGB pixelated OLED display is that the individual pixels within the OLED display each emit one of red, green, and blue colored light and the red, green, and blue emitting pixels are distributed evenly across the display. By selectively illuminating individual pixels within the display based on their respective color relative to neighboring pixels, the pixels are used to create a pattern of overall colors and intensities that yield the desired images.

SUMMARY

Implementations described and claimed herein provide a computing device comprising a display, a first temperature sensor to detect a first temperature of the display, a second temperature sensor to detect a second temperature of the display, a temperature aggregator to aggregate the detected temperatures and determine a low temperature of the display, and a dynamic voltage display driver to vary driving voltage applied to the display based on the determined low temperature of the display.

Implementations described and claimed herein further provide a computing device comprising a first display, a first temperature sensor to detect a temperature of the first display, a second display, a second temperature sensor to detect a temperature of the second display, a temperature aggregator to aggregate the detected temperatures and determine a low temperature of the displays, and a dynamic voltage display driver to vary driving voltage applied to the displays based on the determined low temperature of the displays.

Implementations described and claimed herein still further provide a method of dynamically driving one or more displays of a computing device. The method comprises detecting a first display temperature, detecting a second display temperature, aggregating the detected display temperatures to identify a low temperature within the displays, and changing a driving voltage for the displays based on the identified low temperature.

Other implementations are also described and recited herein. This Summary is provided to introduce a selection of concepts in a simplified form that are further described below in the Detailed Descriptions. This Summary is not intended to identify key features or essential features of the claimed subject matter, nor is it intended to be used to limit the scope of the claimed subject matter.

BRIEF DESCRIPTIONS OF THE DRAWINGS

DETAILED DESCRIPTIONS

With increasing consumer expectations of digital display performance, including accurate and consistent image quality, color variation across the display area is increasingly unacceptable to consumers. Further, as some consumer devices now incorporate multiple displays oriented in close proximity to one another, variations in color between multiple adjacent displays is more noticeable to consumers.

Color output, particularly for organic light-emitting diode (OLED) displays, may vary substantially as a function of display temperature, which changes over time. Prior art OLED displays do not account for temperature variations between regions of a singular display, or between multiple adjacent displays, let alone account for temperature variation over time. As such, variations in color may be visible and unacceptable to the user in prior art OLED displays.

Luminance of each of the pixels within an OLED display is defined by the current flowing therethrough, which is a function of the applied voltage and resistivity of the pixels. Temperature affects the resistivity of the pixels and thus the current flowing therethrough if voltage is held constant. The temperature response of red vs. green vs. blue pixels differs, particularly at low applied voltage levels. As a result, the relative luminance of red vs. green vs. blue may vary with temperature changes, which may yield an undesirable overall color variance of the desired images. For example, at particularly low temperatures, the desired images may take on a green-tinted hue.

The presently disclosed systems and methods dynamically adjust driving voltage to maintain color quality within a desired specification, while also reducing (or in some implementations, minimizing) power consumption. Further, the presently disclosed systems and methods dynamically adjust vapor chamber operation to distribute thermal energy away from hot regions and toward cold regions of a display to reduce the adjustment in driving voltage required to maintain color quality within the desired specification.

Figure 1:
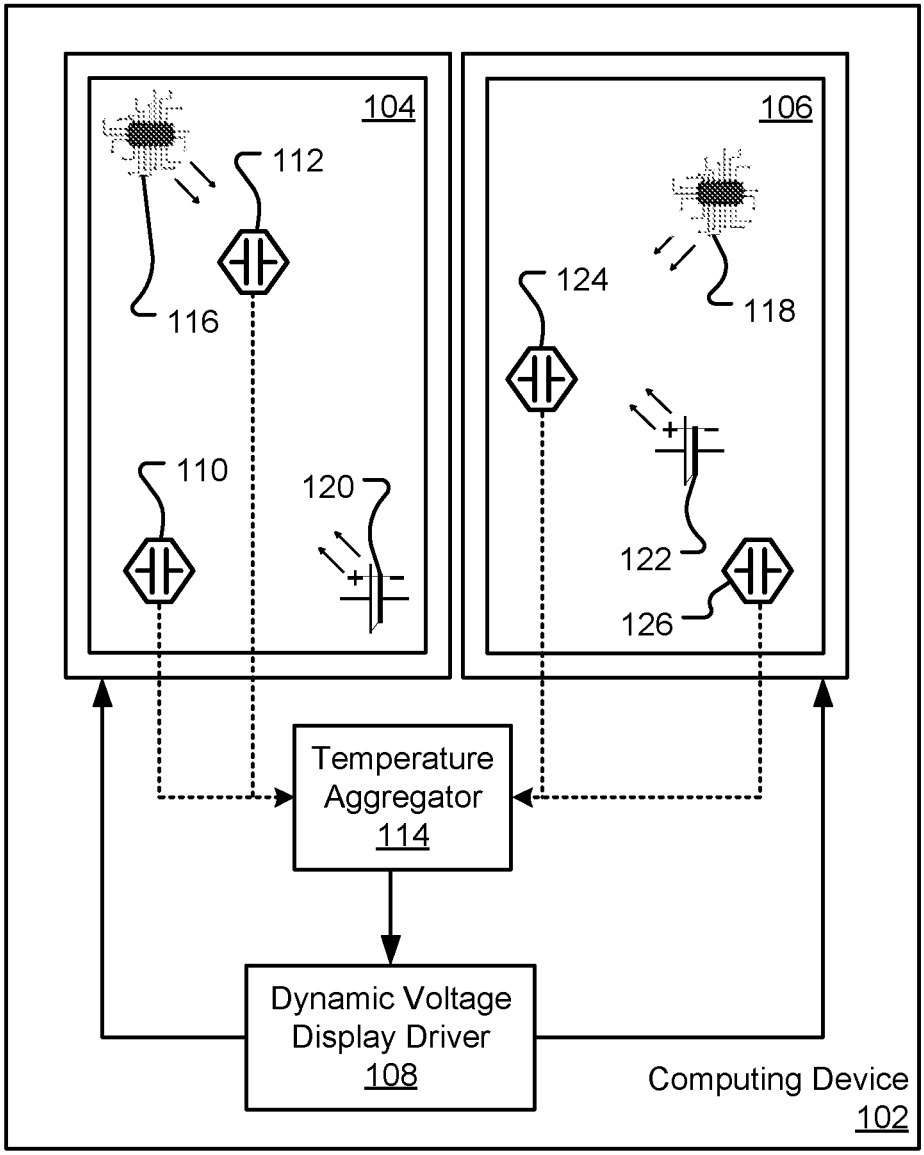
FIG. 1 illustrates a pair of organic light-emitting diode (OLED) displays, each driven by a dynamic voltage display driver.

FIG. 1 illustrates a computing device 102 including a pair of OLED displays 104, 106, each driven by a dynamic voltage display driver 108. In various implementations, overall temperature may vary between the displays 104, 106, as well as local temperature across the display area of each of the displays 104, 106 may also vary. Without the dynamic voltage display driver 108, the resulting color output between the displays 104, 106 may vary, as well as the resulting color output on each of the displays 104, 106 may vary across the display area of each of the displays 104, 106. These variations in color may be noticeable and undesirable to a user, particularly when the displays 104, 106 are placed physically adjacent to one another and are viewed by the user simultaneously. While the computing device 102 is depicted and described as having two displays 104, 106, other computing devices may have only one display. In such cases, the dynamic voltage display driver 108 regulates driving voltage of only one display to output uniform color on a singular display. Similarly, other computing devices may also have more than two displays. In such cases, the dynamic voltage display driver 108 regulates driving voltage of each display to output uniform color on each display.

Display 104 includes a first pair of temperature sensors 110, 112 and display 106 includes a second pair of temperature sensors 124, 126. The temperature sensors 110, 112 each output a signal corresponding to the display 104 temperature and the temperature sensors 124, 126 each output a signal corresponding to the display 106 temperature to a temperature aggregator 114. In various implementations, temperature sensors 110, 112, 124, 126 may take the form of thermistors, resistance temperature detectors (RTDs), and/or thermocouples.

As explained in further detail below with reference to FIG. 2., low temperatures drive divergent luminance responses for red vs. green vs. blue pixels. As a result, the temperature aggregator 114 may take the lowest detected temperature and output that value to the dynamic voltage display driver 108 for determining an appropriate voltage to drive the displays 104, 106.

In other implementations, the temperature aggregator 114 may include thermal maps of the displays 104, 106 based on the presence and relative location of thermal energy generators or heat generating components (e.g., system-on-chips (SOCs) 116, 118, batteries 120, 122, and other heat-generating components) and thermal energy sinks (e.g., dynamic vapor chamber 336 of FIG. 3) within each the displays 104, 106. The signals output from temperature sensors 110, 112, 124, 126 are input into the thermal maps of the displays 104, 106 to find a low temperature of each the displays 104, 106, which may be lower than the detected temperatures at the temperature sensors 110, 112, 124, 126.

In other implementations, the displays 104, 106 may each include a singular temperature sensor output directly to the dynamic voltage display driver 108 (omitting the temperature aggregator 114) or more than two temperature sensors within each of the displays 104, 106. For example, one or both of the displays 104, 106 could include a grid (e.g., a 2×2, a4×4, or a 6×6 grid) of equally spaced temperature sensors that in combination are used to create a temperature distribution map of one or both of the displays 104, 106.

The dynamic voltage display driver 108 has access to a look-up table (not shown, see e.g., look-up table 568 of FIG. 5), which relates an output from the temperature aggregator 114 to appropriate driving voltages for each of the displays 104, 106, which may vary from one another. Further, as the temperatures of the displays 104, 106 change over time, the dynamic voltage display driver 108 will also change the output voltage to each of the displays 104, 106 to maintain color uniformity across the display area of each of the displays 104, 106 over time.

While the presently disclosed technology is specifically described with reference to OLED displays, it may apply to other self-emitting electroluminescent display technologies (e.g., passive-matrix OLED (PMOLED), active-matrix OLED (AMOLED), non-organic LED, fluorescent, or other display technologies) with color-patterned pixels (RGB, WRGB, or other). Further, the OLED (or other type) displays described in detail herein may be incorporated into a variety of computing devices (e.g., laptop computers, personal computers, gaming devices, smart phones, smart TVs, or other devices that carry out one or more specific sets of arithmetic and/or logical operations).

Figure 2:
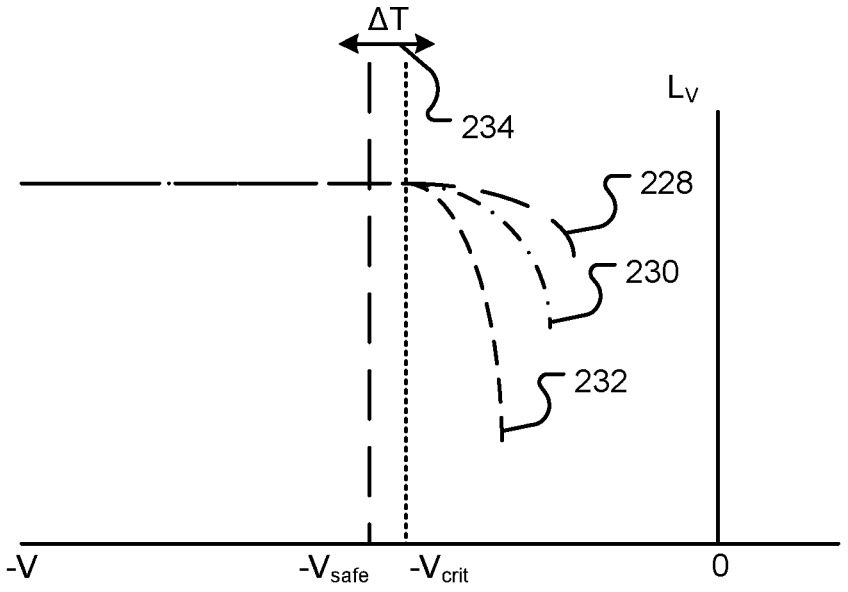
FIG. 2 illustrates luminance ($L_v$) as a function of driving voltage (−V) for red, green, and blue pixels within an OLED display.

FIG. 2 illustrates luminance ($L_v$) as a function of driving voltage (−V) or electroluminescent voltage source (ELVSS) for red, green, and blue pixels within an OLED display. At higher driving voltage levels, the relative luminance of red, green, and blue pixels within the OLED display is substantially the same (within 1% RGB pixel intensity variation) when an equivalent current is applied to the pixels. However, as the driving voltage drops, luminance of the pixels can become unstable, with red, green, and blue pixels reacting substantially differently (e.g., greater than 5% RGB pixel intensity variation) below a critical voltage ($V_{crit}$) as the voltage approaches 0. For purposes of example, green pixel luminance is illustrated by curve 228, blue pixel luminance is illustrated by curve 230, and red pixel luminance is illustrated by curve 232.

The critical voltage ($V_{crit}$) changes as a function of display temperature with lower display temperatures requiring a higher driving voltage level to maintain current flow and thus color uniformity within the OLED display. This is illustrated by arrow 234, which moves $V_{crit}$ as a function of changes in display temperature (ΔT). Further, to accommodate panel-to-panel variations and provide a margin for error, an ELVSS margin may be added to $V_{crit}$ to yield $V_{safe}$, which may be used as a baseline for the display driving voltage (e.g., $V_{safe}=V_{crit}$+ELVSS margin).

In various implementations, $V_{safe}$ is targeted as a driving voltage for one or more associated OLED displays. $V_{safe}$ permits red, green, and blue pixel output within the OLED display to be substantially the same (e.g., less than 5% RGB pixel intensity variation), keeping an acceptable margin of error, when an equivalent current is applied to the pixels. $V_{safe}$ also keeps display power consumption low by reducing (or in some implementations, minimizing) the driving voltage. Therefore, the driving voltage is defined by $V_{safe}$, which in turn is defined by display temperature, particularly a low point of the display temperature. Further, as $V_{safe}$ changes over time due to changes in temperature of the OLED displays, the driving voltage may similarly change over time to maintain color uniformity.

In an example implementation, the $V_{safe}$ to illuminate a display with less than 5% variance at 350 nit and at 20 degrees Celsius is −2.5 v. To illuminate the same display also with less than 5% variance at 350 nit, but at 0 degrees Celsius is −3.7 v. For example, the display may consume up to 40% (e.g., 20-40%) less power when operated at −2.5 v as compared to being operated at −3.7 v.

Figure 3:
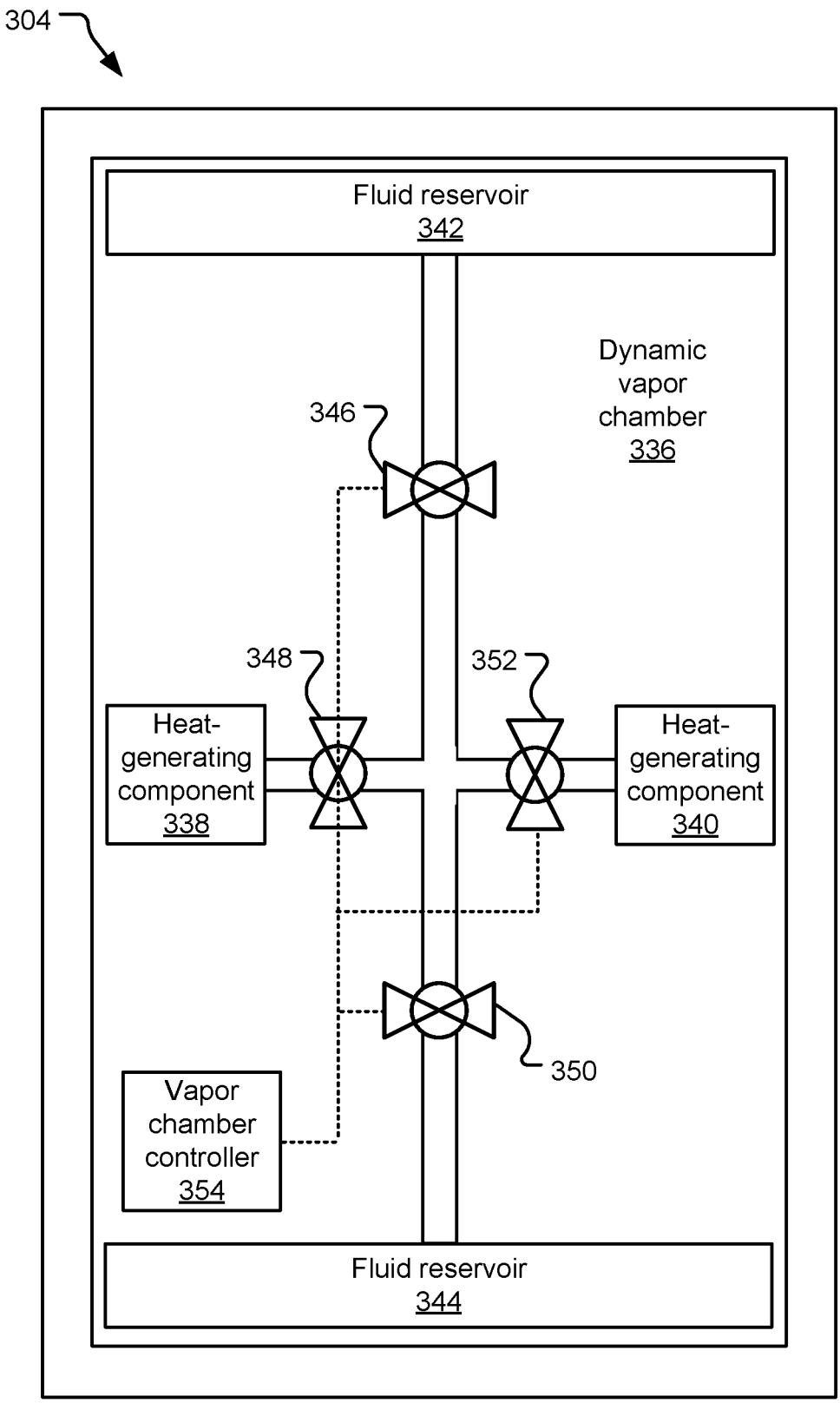
FIG. 3 illustrates a dynamic vapor chamber (or series of heat pipes) for an OLED display.

FIG. 3 illustrates a dynamic vapor chamber (or series of heat pipes) 336 for an OLED display 304. The vapor chamber 336 is oriented behind the display screen (omitted to illustrate the vapor chamber 336) and functions by circulating fluid within the vapor chamber 336 from areas adjacent to heat-generating components 338, 340 to fluid reservoirs 342, 344 or other heat sinks. The fluid transitions from a liquid-phase to a gaseous-phase adjacent the heat-generating components 338, 340 thereby consuming thermal energy and then transitions back to a liquid-phase at the fluid reservoirs 342, 344. The phase-changing fluid within the vapor chamber 336 permits the vapor chamber 336 to transfer a large amount of thermal energy from the heat-generating components 338, 340 to the fluid reservoirs 342, 344.

Further, the vapor chamber 336 is dynamic in that it includes valves 346, 348, 350, 352 that selectively open, throttle, or close fluid paths between the heat-generating components 338, 340 and the fluid reservoirs 342, 344. A vapor chamber controller 354 controls the opening, throttling, or closing of the valves 346, 348, 350, 352 based on input from a temperature aggregator (not shown, see e.g., temperature aggregator 114 of FIG. 1).

More specifically, the vapor chamber 336 may be operated in a manner to aid in achieving a desired display temperature, and in some implementations display temperature uniformity across the display area. For example, if the display 304 is colder than desired, the vapor chamber controller 354 may close the valves 346, 348, 350, 352 to permit the display 304 to heat up more quickly. As the display 304 achieves a desired temperature, the controller 354 may throttle or open entirely the valves 346, 348, 350, 352 to maintain the desired display temperature.

In a further example, if the temperature aggregator indicates that a discrete area of the display is colder than desired, the controller 354 may open specific valves that transfer thermal energy to or near that discrete area and/or close specific valves that transfer thermal energy away from that discrete area. Similarly, if the temperature aggregator indicates that a discrete area of the display is warmer than desired, the controller 354 may close specific valves that transfer thermal energy to or near that discrete area and/or open specific valves that transfer thermal energy away from that discrete area. Further, the valves may all be selectively throttled to maintain a desired display temperature and/or temperature distribution across the display 304.

In some implementations, the temperature aggregator is omitted and the controller 354 opens, throttles, and closes valves based on direct input from one or more temperature sensors (not shown, see e.g., temperature sensors 110, 112, 124, 126) within the display 304 or input from a dynamic voltage display driver (not shown, see e.g., driver 108 of FIG. 1).

While FIG. 3 illustrates two heat-generating components 338, 340, two fluid reservoirs 342, 344, and four valves 346, 348, 350, 352 with fluid lines running therebetween, any number of heat-generating components, fluid reservoirs, heat-sinks, and valves may be used with any arrangement of fluid lines running therebetween depending on the specific design and arrangement of the display 304. In various implementations, the dynamic vapor chamber 336 is used in conjunction with a dynamic voltage display driver to both influence temperature on the display (in discrete areas and/or overall) and change display driving voltage based on the temperature of the display.

Figure 4:
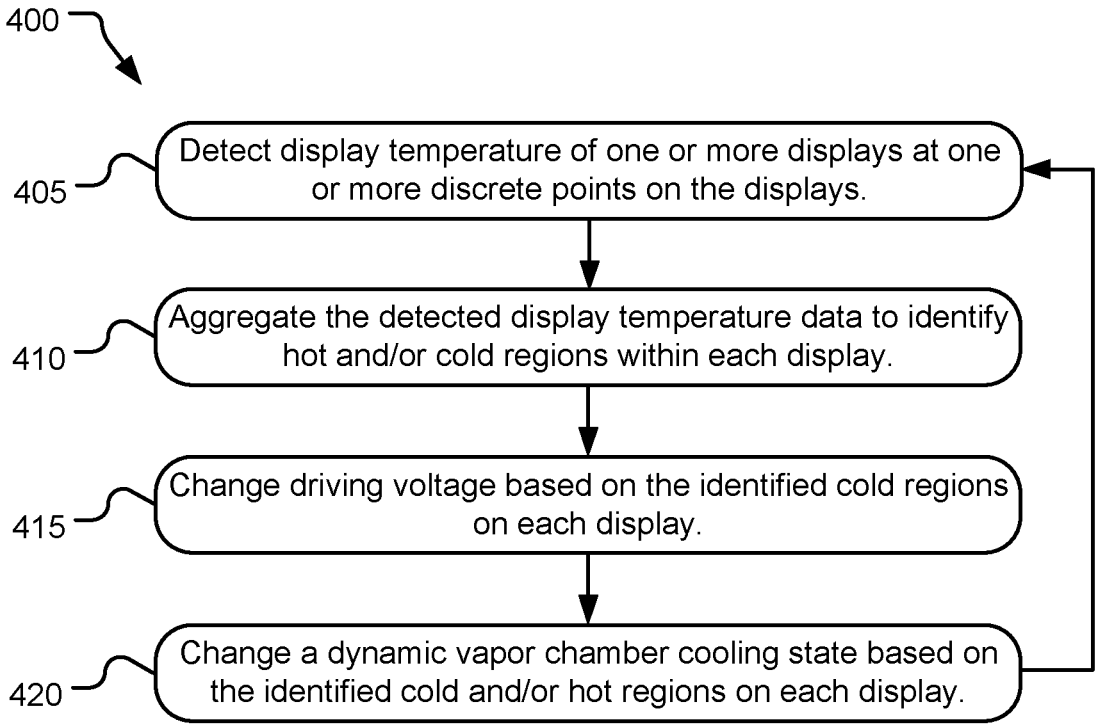
FIG. 4 illustrates example operations for dynamically driving one or more OLED displays of a computing device.

FIG. 4 illustrates example operations 400 for dynamically driving one or more OLED displays of a computing device. A detecting operation 405 detects display temperature of the one or more displays at one or more discrete points on the displays. In some implementations, the computing device includes a singular display. As such, the detecting operation 405 detects temperature of at least two points distributed across the display. In other implementations, the computing device includes two or more displays. As such, the detecting operation 405 detects temperature of at least one points on each display, and perhaps at least two points distributed across each display. The detecting operation 405 collects sufficient data to determine temperature, and perhaps a temperature distribution across each associated display.

An aggregating operation 410 aggregates the detected display temperature data to identify hot and/or cold regions within each display. In some implementations, the aggregating operation 410 may select the lowest detected temperature and relative location on a display (identified as a cold region) and select the highest detected temperature and relative location on a display (identified as a hot region). In other implementations, the aggregating operation 410 incorporates a temperature gradient function to estimate display temperature across a display area based on the detected temperatures. As such, identified cold and hot regions may be spaced apart from and at different temperatures than the raw detected display temperature data.

A first changing operation 415 changes driving voltage based on the identified cold region(s) of each display. As the cold region(s) define a minimum driving voltage to achieve the desired color uniformity on the display(s), the first changing operation 415 consults a look-up table and matches a driving voltage to the identified cold region temperature and outputs the matched driving voltage to the display(s). In implementations where the computing device includes multiple displays, the selected driving voltage may be the same for each display, or the first changing operation 415 may select multiple driving voltages, each for a specific display and based upon the identified cold region(s) on the associated display.

A second changing operation 420 changes a dynamic vapor chamber cooling state based on the identified cold regions and/or the identified hot regions on each display. The dynamic vapor chamber included within the computing device and behind one or more of the displays may be used to influence the temperature of the cold and/or hot regions so that the first changing operation 415 is better utilized. For example, the dynamic vapor chamber may include valves between heat-generating components and heat sinks within the computing device. The second changing operation 420 selectively opens and closes the valves to selectively heat the cold-region(s) and/or cool the hot-region(s) of each display. This permits each display to be of a more uniform temperature and reduces the magnitude that the first changing operation 415 changes the driving voltage(s).

In various implementations, the operations 400 may iteratively and automatically repeat to continuously update the detected temperatures, identified hot and/or cold regions, display driving voltage, and vapor chamber cooling state.

Figure 5:
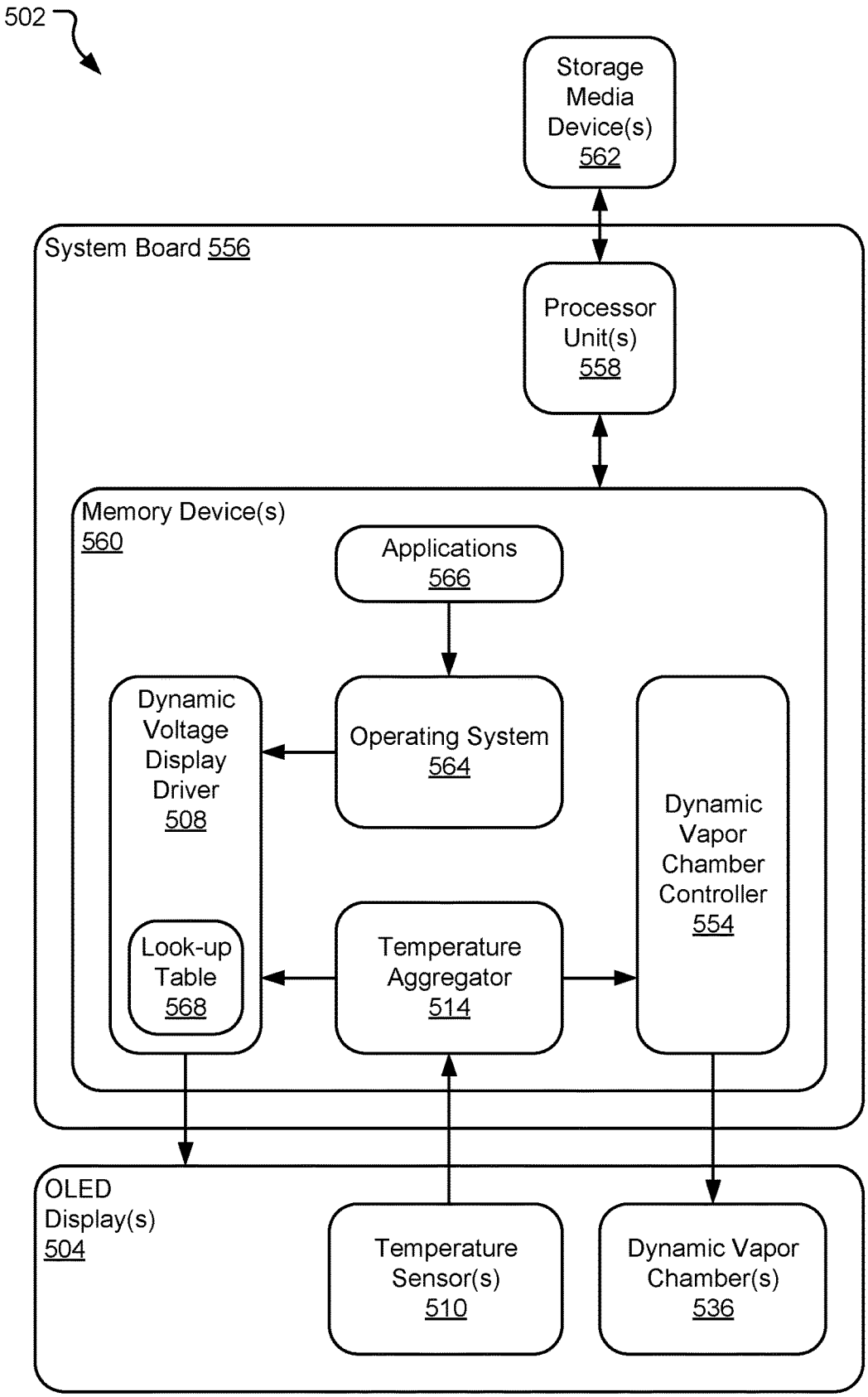
FIG. 5 illustrates a computing system incorporating a dynamic voltage display driver and a dynamic vapor chamber(a) for OLED display(s).

FIG. 5 illustrates a computing system 502 incorporating a dynamic voltage display driver 508 and dynamic vapor chamber(s) 536 for OLED display(s) 504. The computing system 502 may include a system board 556, upon which a variety of microelectronic components for the computing system 502 are attached and interconnected. For example, the system board 556 may include one or more processor units 558 (e.g., discrete or integrated microelectronic chips and/or separate but integrated processor cores, including but not limited to central processing units (CPUs) and graphic processing units (GPUs)) and at least one memory device 560 (which may be integrated into systems or chips of the computing system 502). The computing system 502 may also include storage media device(s) 562 (e.g., a flash or hard disk drive), one or more OLED display(s) 504, and other input/output devices (not shown).

The memory device(s) 560 and the storage media device(s) 562 may include one or both of volatile memory (e.g., random-access memory (RAM)) and non-volatile memory (e.g., flash memory or magnetic storage). An operating system 564, such as one of the varieties of the Microsoft Windows® operating system, resides in the memory device(s) 560 and/or the storage media device(s) 562 and is executed by at least one of the processor units 558, although other operating systems may be employed. One or more additional applications 566 are loaded in the memory device(s) 560 and/or the storage media device(s) 562 and executed within the operating system 564 by at least one of the processor units 558.

The OLED display(s) 504 include at least two temperature sensors 510, both on a singular display or distributed across multiple displays. A temperature aggregator 514 collects and aggregates the detected temperatures and determines a low temperature of the display(s) 504. The determined low temperature is output to dynamic voltage display driver 508, which consults a look-up table 568 which correlates the low temperature output from the temperature aggregator 514 with corresponding driving voltage values to maintain color quality within acceptable tolerances within the display(s) 504. The driver 508 also receives a signal from the operating system 564 which defines the pattern of colors to be output to the display(s) 504. The driver 508 drives a signal to the display(s) 504 that yields the desired pattern of colors at a driving voltage defined by the look-up table 568. In various implementations, the display signal includes a sequence of frames for visual representation on the display(s) 504.

The temperature aggregator 514 also identifies one or both of hot and cold regions within the display(s) 504. The location and relative temperature of the hot and cold regions is output to a dynamic vapor chamber controller 554, which controls a series of valves controlling fluid flow through dynamic vapor chamber(s) 536 within the display(s) 504. The valves are actuated by the controller 554 to selectively open, throttle, and/or close to address the hot and/or cold regions within the display(s) 504. More specifically, the dynamic vapor chamber(s) 536 selectively transfers thermal energy away from identified hot regions and toward identified cold regions by manipulating the valves controlling fluid flow through the dynamic vapor chamber(s) 536.

The computing system 502 may include a variety of tangible computer-readable storage media (e.g., the memory device(s) 560 and the storage media device(s) 562) and intangible computer-readable communication signals. Tangible computer-readable storage can be embodied by any available media that can be accessed by the computing system 502 and includes both volatile and non-volatile storage media, as well as removable and non-removable storage media implemented in any method or technology for storage of information such as computer readable instructions, data structures, program modules or other data. Tangible computer-readable storage media includes, but is not limited to, RAM, read-only memory (ROM), electrically erasable programmable read-only memory (EEPROM), flash memory or other memory technology, compact disc read-only memory (CD-ROM), digital versatile disks (DVD) or other optical disk storage, magnetic cassettes, magnetic tape, magnetic disk storage or other magnetic storage devices, or any other tangible medium which can be used to store the desired information and which can be accessed by the computing system 502. Tangible computer-readable storage media excludes intangible communications signals.

Intangible computer-readable communication signals may embody computer readable instructions, data structures, program modules or other data resident in a modulated data signal, such as a carrier wave or other signal transport mechanism. The term "modulated data signal" means a signal that has one or more of its characteristics set or changed in such a manner as to encode information in the signal. By way of example, and not limitation, intangible communication signals include signals traveling through wired media such as a wired network or direct-wired connection, and wireless media such as acoustic, radio-frequency (RF), infrared (IR), and other wireless media.

Some embodiments may comprise an article of manufacture. An article of manufacture may comprise a tangible storage medium to store logic. Examples of a storage medium may include one or more types of computer-readable storage media capable of storing electronic data, including volatile memory or non-volatile memory, removable or non-removable memory, erasable or non-erasable memory, writeable or re-writeable memory, and so forth. Examples of the logic may include various software elements, such as software components, programs, applications, computer programs, application programs, system programs, machine programs, operating system software, middleware, firmware, software modules, routines, subroutines, operation segments, methods, procedures, software interfaces, application program interfaces (APIs), instruction sets, computing code, computer code, code segments, computer code segments, words, values, symbols, or any combination thereof. In one embodiment, for example, an article of manufacture may store executable computer program instructions that, when executed by a computer, cause the computer to perform methods and/or operations in accordance with the described embodiments. The executable computer program instructions may include any suitable type of code, such as source code, compiled code, interpreted code, executable code, static code, dynamic code, and the like. The executable computer program instructions may be implemented according to a predefined computer language, manner or syntax, for instructing a computer to perform a certain operation segment. The instructions may be implemented using any suitable high-level, low-level, object-oriented, visual, compiled and/or interpreted programming language.

Some embodiments of the invention described herein are implemented as logical steps in one or more computer systems. The logical operations are implemented (1) as a sequence of processor-implemented steps executing in one or more computer systems and (2) as interconnected machine or circuit modules within one or more computer systems. The implementation is a matter of choice, dependent on the performance requirements of the computer system implementing the invention. Accordingly, the logical operations described herein are referred to variously as operations, steps, objects, or modules. Furthermore, the logical operations may be performed in any order, adding or omitting operations as desired, unless explicitly claimed otherwise or a specific order is inherently necessitated by the claim language.

An example computing device according to the presently disclosed technology comprises a display, a first temperature sensor to detect a first temperature of the display, a second temperature sensor to detect a second temperature of the display, a temperature aggregator to aggregate the detected temperatures and determine a low temperature of the display, and a dynamic voltage display driver to vary driving voltage applied to the display based on the determined low temperature of the display.

In another example computing device according to the presently disclosed technology, the temperature aggregator applies a temperature gradient function to estimate display temperature across a display area based on the detected temperatures.

In another example computing device according to the presently disclosed technology, the dynamic voltage display driver targets a minimum driving voltage that yields RGB pixel intensity variation less than 5%.

Another example computing device according to the presently disclosed technology further comprises a dynamic vapor chamber including one or more valves between heat-generating components of the computing device and the display, wherein the valves are selectively actuated to affect the detected temperatures of the display.

In another example computing device according to the presently disclosed technology, the display is an organic light-emitting diode (OLED) display.

Another example computing device according to the presently disclosed technology further comprises a storage device to store a series of driving voltages, each associated with a potential low temperature of the display.

An example computing device according to the presently disclosed technology comprises a first display, a first temperature sensor to detect a temperature of the first display, a second display, a second temperature sensor to detect a temperature of the second display, a temperature aggregator to aggregate the detected temperatures and determine a low temperature of the displays, and a dynamic voltage display driver to vary driving voltage applied to the displays based on the determined low temperature of the displays.

In another example computing device according to the presently disclosed technology, the temperature aggregator applies a temperature gradient function to estimate display temperature across a display area of each display based on the detected temperatures.

In another example computing device according to the presently disclosed technology, the temperature aggregator further to determine a low temperature of each display. The dynamic voltage display driver further to independently vary the driving voltage applied to each display based on the determined low temperature of each display.

In another example computing device according to the presently disclosed technology, the dynamic voltage display driver targets a minimum driving voltage that yields RGB pixel intensity variation less than 5%.

Another example computing device according to the presently disclosed technology further comprises a dynamic vapor chamber including one or more valves between heat-generating components of the computing device and one or both of the displays, wherein the valves are selectively actuated to affect the detected temperatures of one or both of the displays.

In another example computing device according to the presently disclosed technology, the displays are organic light-emitting diode (OLED) displays.

Another example computing device according to the presently disclosed technology further comprises a storage device to store a series of driving voltages, each associated with a potential low temperature of the displays.

An example method of dynamically driving one or more displays of a computing device according to the presently disclosed technology comprises detecting a first display temperature, detecting a second display temperature, aggregating the detected display temperatures to identify a low temperature within the displays, and changing a driving voltage for the displays based on the identified low temperature.

In another example method according to the presently disclosed technology, the aggregating operation further identifies one or both of hot and cold regions within the displays, the method further comprising changing a dynamic vapor chamber cooling state based on one or both of the identified hot and cold regions within the displays.

In another example method according to the presently disclosed technology, the first display temperature and the second display temperature are each within one display.

In another example method according to the presently disclosed technology, the first display temperature and the second display temperature are each within separate displays.

In another example method according to the presently disclosed technology, the aggregating operation applies a temperature gradient function to estimate display temperature across a display area based on the detected temperatures.

In another example method according to the presently disclosed technology, the changing operation targets a minimum driving voltage that yields RGB pixel intensity variation less than 5%.

In another example method according to the presently disclosed technology, the displays are organic light-emitting diode (OLED) displays.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A computing device comprising:

a display;

a first temperature sensor to detect a first temperature of the display;

a second temperature sensor to detect a second temperature of the display;

a fluid reservoir to act as a heat sink;

two or more heat-generating components;

a dynamic vapor chamber fluidly connecting the fluid reservoir and the heat-generating components, the dynamic vapor chamber including two or more valves, a first one of the valves oriented between the heat-generating components, a second one of the valves oriented between the heat sink and one or more of the heat-generating components, the dynamic vapor chamber defining a bi-directional flowpath between the heat-generating components and the fluid reservoir; and a vapor chamber controller to selectively actuate the valves to affect the detected temperatures of the display.

2. The computing device of claim 1, wherein the display is an organic light-emitting diode (OLED) display.

3. The computing device of claim 1, further comprising:

a storage device to store a series of driving voltages, each associated with a potential low temperature of the display.

4. The computing device of claim 1, further comprising:

a temperature aggregator to aggregate the detected temperatures and determine a lowest detected temperature of the display.

5. The computing device of claim 4, wherein the temperature aggregator applies a temperature gradient function to estimate display temperature across a display area based on the detected temperatures.

6. The computing device of claim 4, further comprising:

a dynamic voltage display driver to set overall driving voltage applied to the display above a $V_{crit}$, wherein $V_{crit}$ is a minimum magnitude voltage that yields RGB pixel intensity variation less than 5% at the determined lowest detected temperature of the display.

7. A computing device comprising:

a first display;

a first temperature sensor to detect a temperature of the first display;

a second display;

a second temperature sensor to detect a temperature of the second display;

a fluid reservoir in one of the first display and the second display to act as a heat sink;

two or more heat-generating components in the one of the first display and the second display;

a dynamic vapor chamber fluidly connecting the fluid reservoir and the heat-generating components, the dynamic vapor chamber including two or more valves, a first one of the valves oriented between the heat-generating components, a second one of the valves oriented between the heat sink and one or more of the heat-generating components, the dynamic vapor chamber defining a bi-directional flowpath between the heat-generating components and the fluid reservoir; and a vapor chamber controller to selectively actuate the valves to affect the detected temperatures of the one of the first display and the second display.

8. The computing device of claim 7, wherein the displays are organic light-emitting diode (OLED) displays.

9. The computing device of claim 7, further comprising:

a storage device to store a series of driving voltages, each associated with a potential low temperature of the displays.

10. The computing device of claim 7, further comprising:

a temperature aggregator to aggregate the detected temperatures and determine a lowest detected temperature of the displays.

11. The computing device of claim 10, wherein the temperature aggregator applies a temperature gradient function to estimate display temperature across a display area of each display based on the detected temperatures.

12. The computing device of claim 10, wherein the temperature aggregator further to determine a lowest detected temperature of each display, and wherein the dynamic voltage display driver further to independently set the overall driving voltage applied to each display based on the determined lowest detected temperature of each display.

13. The computing device of claim 10, further comprising:

a dynamic voltage display driver to set overall driving voltage applied to the displays above a $V_{crit}$, wherein $V_{crit}$ is a minimum magnitude voltage that yields RGB pixel intensity variation less than 5% at the determined lowest detected temperature of the displays.

14. A method of dynamically driving one or more displays of a computing device, the method comprising:

detecting a first display temperature;

detecting a second display temperature; and changing a dynamic vapor chamber cooling state, including a selective actuation of two or more valves, a first one of the valves oriented between two or more heat-generating components, a second one of the valves oriented between a fluid reservoir to act as a heat sink and one or more of the heat-generating components, the dynamic vapor chamber defining a bi-directional flowpath between the heat-generating components and the fluid reservoir, the changing operation performed by a vapor chamber controller to affect the detected display temperatures of the one or more displays.

15. The method of claim 14, wherein the first display temperature and the second display temperature are each within one display.

16. The method of claim 14, wherein the first display temperature and the second display temperature are each within separate displays.

17. The method of claim 14, wherein the displays are organic light-emitting diode (OLED) displays.

18. The method of claim 14, further comprising:

aggregating the detected display temperatures to identify a lowest detected temperature within the displays.

19. The method of claim 18, wherein the aggregating operation further identifies one or both of hot and cold regions within the displays, and wherein changing the dynamic vapor chamber cooling state is based on one or both of the identified hot and cold regions within the displays.

20. The method of claim 16, wherein the aggregating operation applies a temperature gradient function to estimate display temperature across a display area based on the detected temperatures.

21. The method of claim 18, further comprising:

setting an overall driving voltage applied to the displays above a $V_{crit}$, wherein $V_{crit}$ is a minimum magnitude voltage that yields RGB pixel intensity variation less than 5% at the identified lowest detected temperature.

* * * * *